US007845933B2

(12) United States Patent
Sung et al.

(10) Patent No.: US 7,845,933 B2
(45) Date of Patent: Dec. 7, 2010

(54) AUTOMATIC GATHERING PRE-SHAPE MACHINE

(75) Inventors: Chung-Ting Sung, Kaohsiung (TW); Yen-Chao Lu, Kaohsiung (TW)

(73) Assignee: New Solid International Corp., Qianjin Dist., Kaohsiung (TW)

( * ) Notice: Subject to any disclaimer, the term of this patent is extended or adjusted under 35 U.S.C. 154(b) by 261 days.

(21) Appl. No.: 12/259,510

(22) Filed: Oct. 28, 2008

(65) Prior Publication Data

US 2010/0104679 A1 Apr. 29, 2010

(51) Int. Cl.
*B29C 33/44* (2006.01)

(52) U.S. Cl. ..... 425/403.1; 414/676; 414/755; 425/348 R; 425/361; 425/436 RM

(58) Field of Classification Search ..... 425/112, 425/193, 413, 397, 348 R, 359, 360, 361, 425/436 RM, 403.1, 117, 437; 414/676, 414/755

See application file for complete search history.

(56) References Cited

U.S. PATENT DOCUMENTS 3,661,489 A * 5/1972 Moore ..... 425/236
3,947,236 A * 3/1976 Lasch, Jr. ..... 432/11
3,956,516 A * 5/1976 Holt et al. ..... 426/420
4,498,857 A * 2/1985 Kinnamon ..... 425/361
4,640,671 A * 2/1987 Wright ..... 425/149
4,836,764 A * 6/1989 Parkinson ..... 425/384
5,017,052 A * 5/1991 Bartylla ..... 406/88
5,634,636 A * 6/1997 Jackson et al. ..... 271/225
5,980,231 A * 11/1999 Arends et al. ..... 425/397
6,086,354 A * 7/2000 Dresen et al. ..... 425/504
6,585,259 B2 * 7/2003 Kerpe et al. ..... 271/195
7,419,462 B1 * 9/2008 Zelinski ..... 493/143

* cited by examiner

*Primary Examiner*—Yogendra N Gupta
*Assistant Examiner*—Emmanuel S Luk
(74) *Attorney, Agent, or Firm*—Burr & Brown

(57) ABSTRACT

An automatic gathering pre-shape machine has a main body and a gathering device. The main body can make plastic films formed into a circular shape with an annular flange formed around a top edge of the film. The gathering device allows a pre-shaped plastic film be blown toward an outer end of the barrel to hit a block wall and drop and mount around a tip portion of corresponding shelf to be gathered. Consequently, the plastic film may easily and automatically be gathered from the main body. Therefore, the plastic films can be kept from being damaged and the pre-shaping process is accelerated.

3 Claims, 6 Drawing Sheets

AUTOMATIC GATHERING PRE-SHAPE MACHINE

BACKGROUND OF THE INVENTION

1. Field of the Invention

The present invention relates to a pre-shape machine, and more particularly to an automatic gathering pre-shape machine to automatically gather pre-shaped plastic films from a molding device to facilitate remove the plastic films and avoid yield loss due to personnel scratch.

2. Description of Related Art

Plastic films are widely used for package of diverse products, are applied on surfaces of the products and are heated by hot air blowers to shrink and tightly enclose the products.

A plastic film applied to a columnar product such as a canned food, stack of optical disks or the like is pre-shaped into a circular shape with an annular flange formed around a top edge of the film. When applying to the columnar product, the plastic film is put around the columnar product with the annular flange being attached on a top of the columnar product. Then, the plastic film is heated and deformed to wrap up the columnar product.

The plastic films are pre-shaped in a pre-shape machine and are manually gathered from a molding device. In such a manner, the plastic films are unavoidably scratched due to personnel carelessness, and the process of pre-shaping the plastic film may become too tedious and time-consuming, particularly to a large number of plastic films be fabricating.

The present invention therefore provides an automatic gathering pre-shape machine to obviate or mitigate the aforementioned problems.

SUMMARY OF THE INVENTION

The main objective of the present invention is to provide an automatic gathering pre-shape machine to automatically gather pre-shaped plastic films from the pre-shape machine and to facilitate remove the plastic films and avoid yield loss due to personnel scratch.

To achieve the objective, the plastic film pre-shape machine comprises a main body and a gathering device.

The main body is installed with a power supplier and has a top surface, a rotating table, a hot air generator and multiple molding devices. The rotating table is mounted rotatably on the top surface of the main body, rotated by the power supplier and kept at specific angular positions in a determined period of time. The hot air generator is mounted adjacent to the rotating table and has multiple nozzles corresponding to and spraying hot air to the rotating table. The molding device has a body, a platform and a driving shaft. The body can be rotatably mounted in the rotating table and has an annular side surface and a top. The platform is detachably mounted in the top of the body. The driving shaft is mounted longitudinally through the body, movably extends longitudinally relative to the body and has a top end attached securely to the platform to selectively raise the platform.

The gathering device is mounted adjacent to the rotating table and has a barrel and at least one shelf. The barrel is mounted securely on the top surface of the main body and has an inner end, an outer end, a longitudinal channel defined in the barrel and an air flow generator. The inner end of the barrel is disposed above the rotating table and has an opening communicating with the longitudinal channel and selectively corresponding to one of the molding devices. The outer end of the barrel has a bottom hole and a block wall extending downwardly adjacent to the bottom hole. The air generator is mounted in the inner end of the barrel and generates airflow flowing toward the outer end of the barrel. The at least one shelf is mounted with the main body, may be slidable relative to the main body and each has a tip portion extending into the bottom hole of the outer end of the barrel. The tip portion has a slope.

When a plastic film is mounted around the body and pre-shaped into a circular shape with an annular flange, the platform is raised by a driving shaft to lift the plastic film from the body. The airflow generated by the air generator of the barrel may blow the plastic film toward the outer end of the barrel, to make the plastic film hit the block wall and drop and mount around the tip portion of corresponding shelf along the slope to be gathered.

Consequently, the plastic film may easily and automatically be gathered from the main body. Therefore, the plastic films can be kept from being damaged and the pre-shaping process is accelerated.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
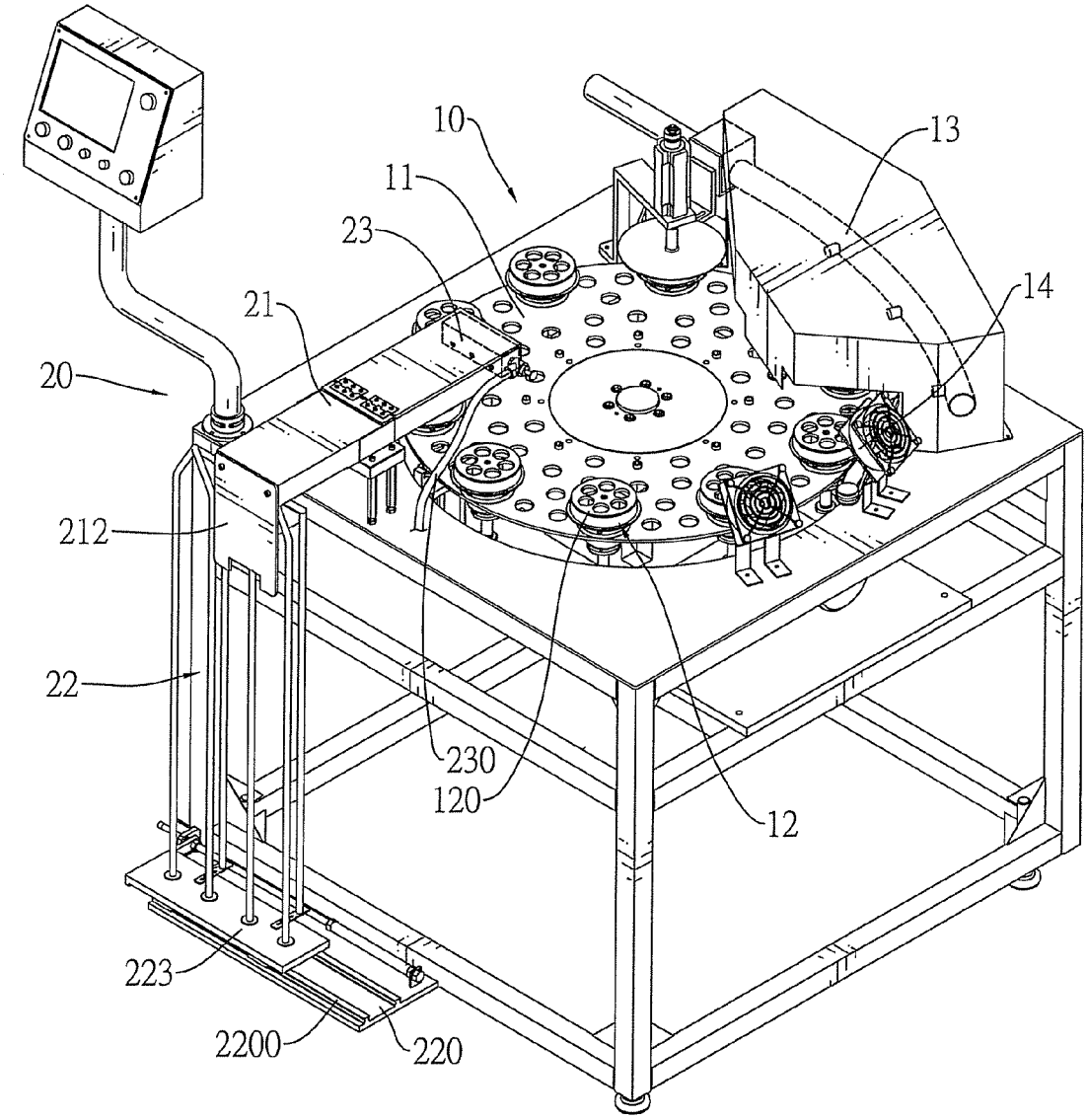
FIG. 1 is a perspective view of an automatic gathering pre-shape machine in accordance with the present invention.
Figure 2:
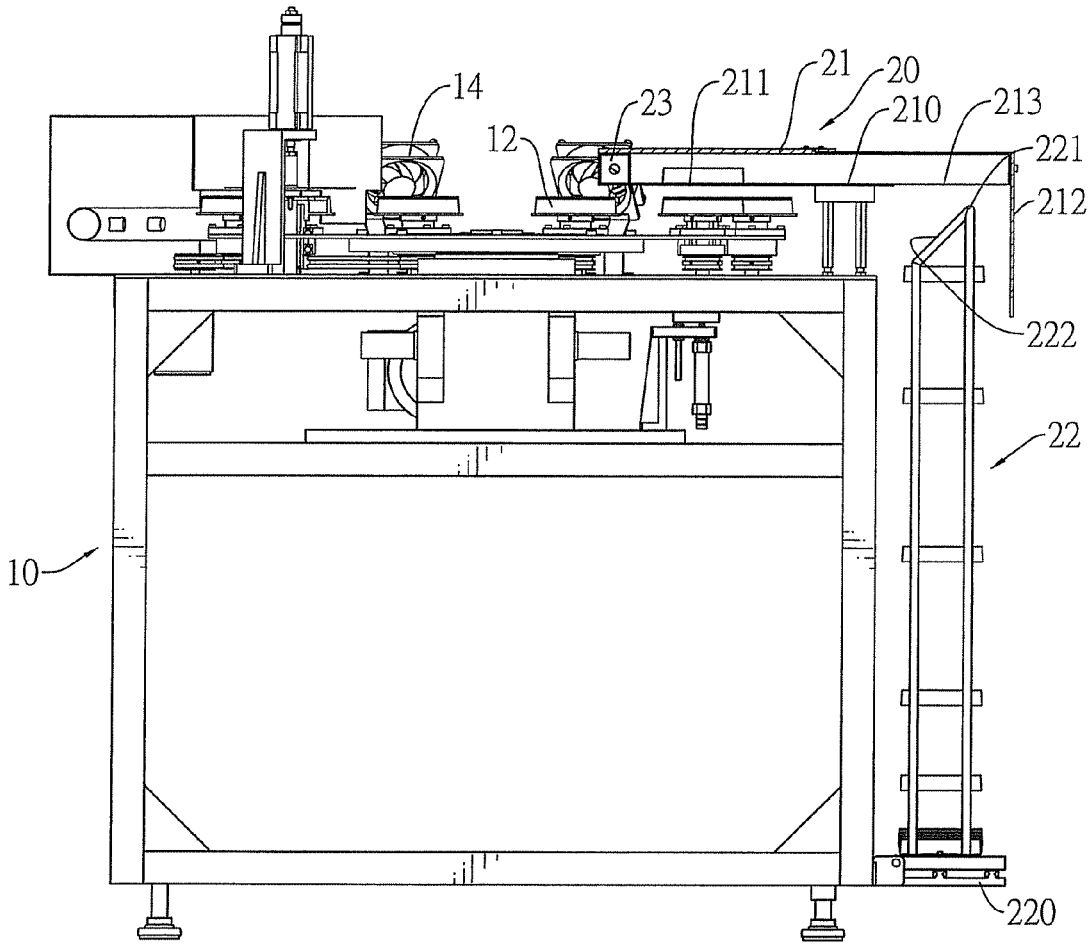
FIG. 2 is a side view of the automatic gathering pre-shape machine in FIG. 1.
Figure 3:
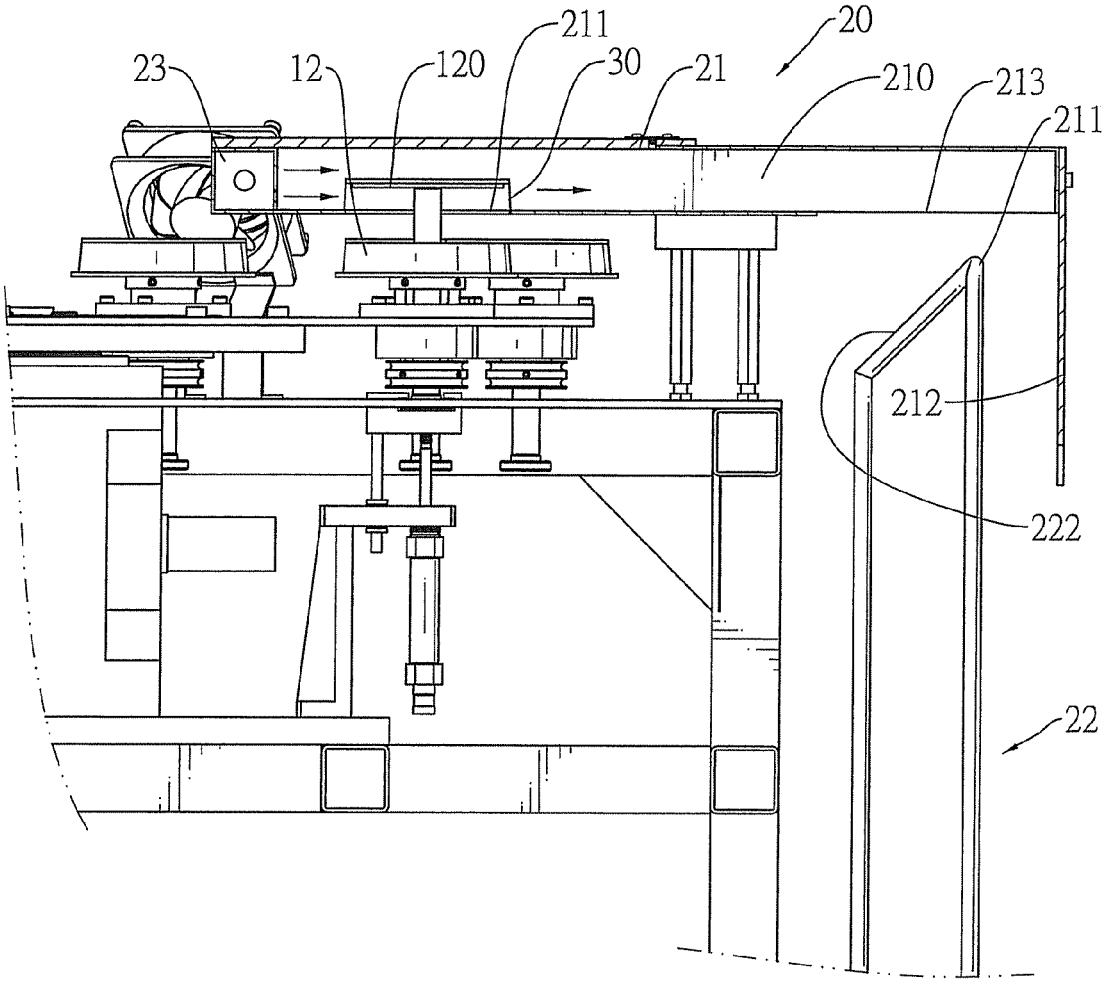
FIGS. 3 to 6 are an enlarged operational side view in partial section of the automatic gathering pre-shape machine in FIG. 1.
Figure 4:
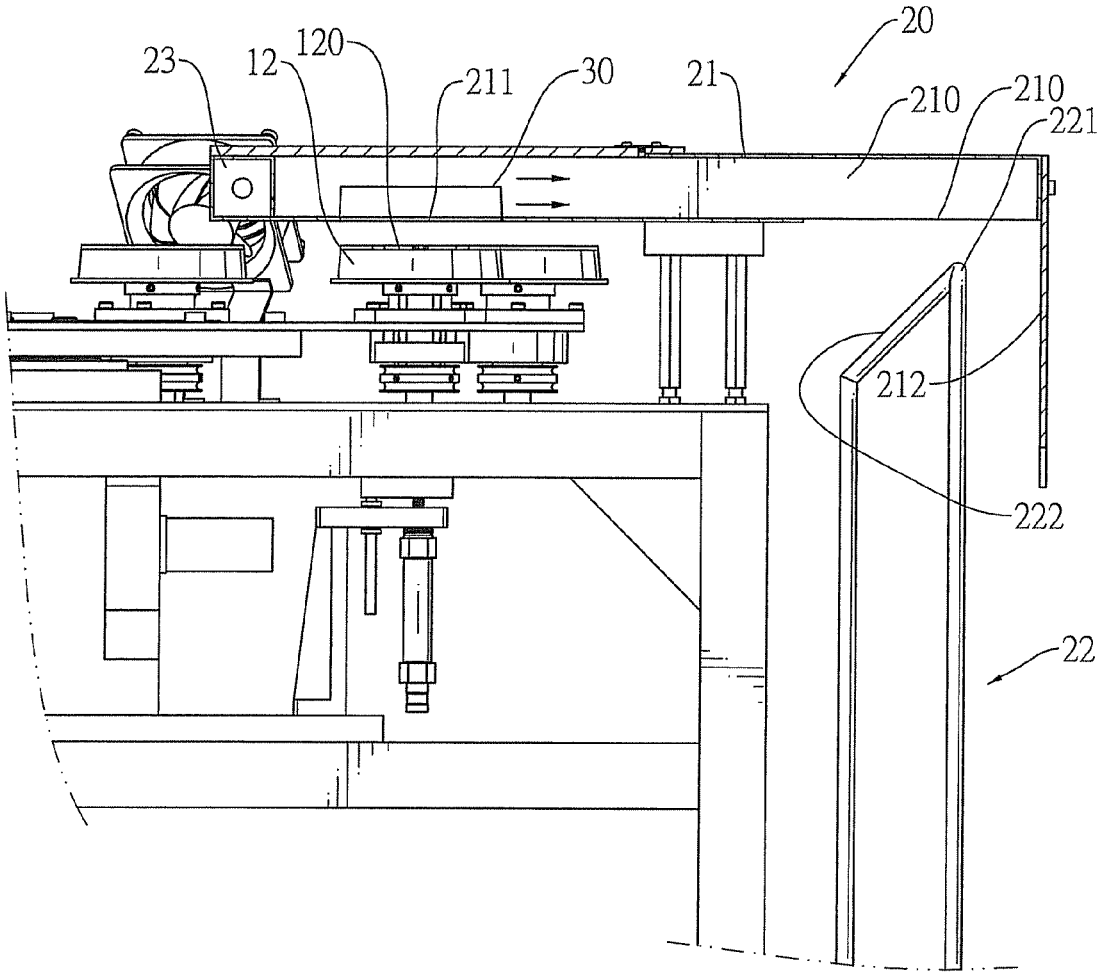
Figure 5:
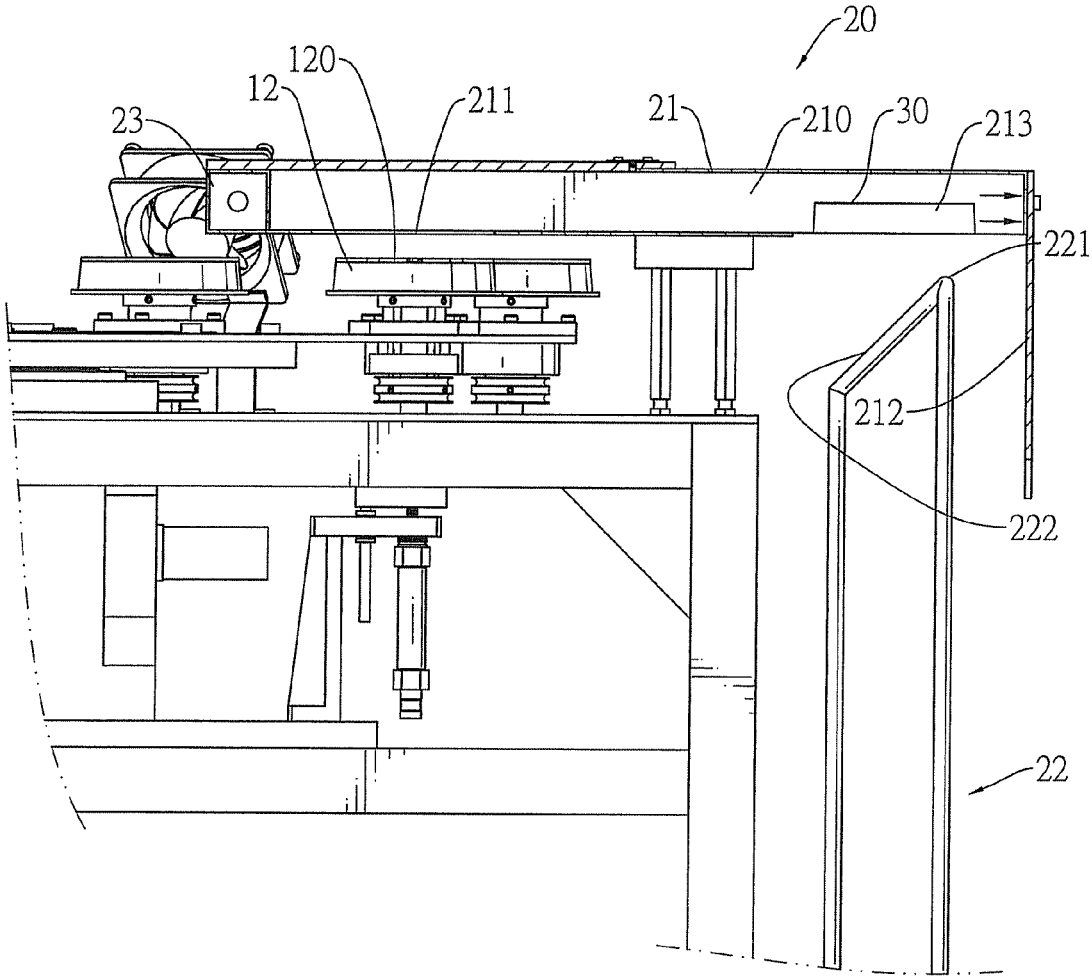
Figure 6:
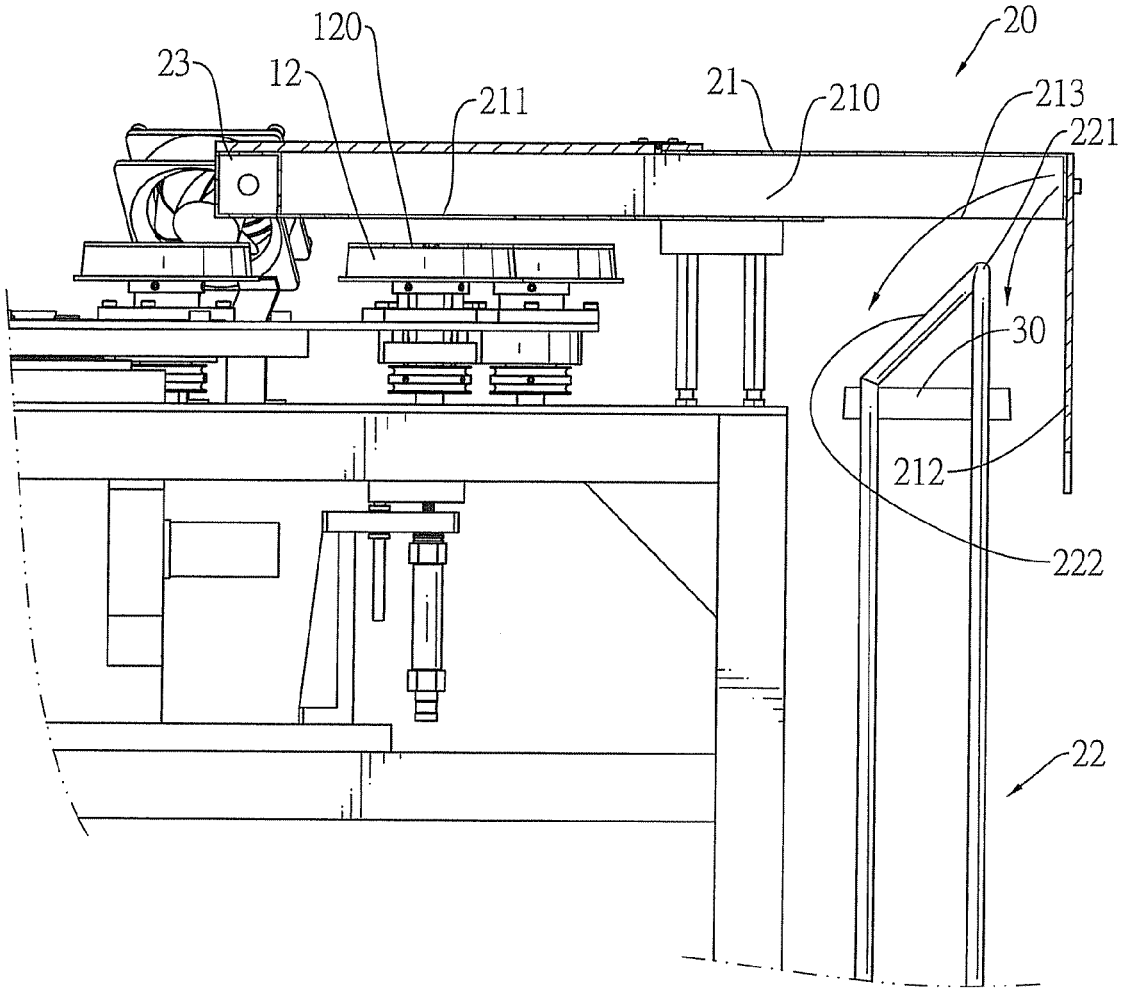

With reference to FIGS. 1, 2 and 3, an automatic gathering pre-shape machine in accordance with present invention comprises a main body (10) and a gathering device (20).

The main body (10) is installed with a power supplier and has a top surface, a rotating table (11), a hot air generator (13), multiple fans (14), a cylinder and multiple molding devices (12). The rotating table (11) is mounted rotatably on the top surface of the main body (10), rotated by the power supplier and kept at specific angular positions in a determined period of time. The hot air generator (13) is mounted adjacent to the rotating table (11) and has multiple nozzles corresponding to and spraying hot air to the rotating table (11). The fans (14) are mounted on the top surface of the main body (10) adjacent to the hot air generator (13) and the rotating table (11). The cylinder is mounted securely in the main body (10) and has an extendable shaft and a connector mounted on an end of the shaft. Each molding device (12) has a body, a platform (120) and a driving shaft. The body is mounted in the rotating table (11) and has an annular side surface and a top. The platform (120) is detachably mounted in the top of the body. The driving shaft is mounted longitudinally through the body and has a top end attached securely to the platform (120) and selectively engaging the connector of the cylinder to movably extend longitudinally relative to the body to selectively raise the platform (120).

The gathering device (20) is mounted adjacent to the rotating table (11) and has a barrel (21) and two shelves (22). The barrel (21) is mounted securely on the top surface of the main body (10) and has an inner end, an outer end, a longitudinal channel (210) defined in the barrel (21) and an air flow generator (23). The inner end of the barrel (21) is disposed above the rotating table (11) and has an opening (211) communicating with the longitudinal channel (210) and selectively corresponding to one of the molding devices (12). The outer end of the barrel (21) has a bottom hole (213) and a block wall (212) extending downwardly adjacent to the bottom hole (213). The air flow generator (23) is mounted in the inner end of the barrel (21), has an air pipe (230) and generates airflow flowing toward the outer end of the barrel (21).

The shelves (22) are mounted on the main body (10) and may be mounted on a stage (223) that is slidably mounted on a board (220) attached to the main body (10) by grooves and rails (2200). Each shelf (22) has a tip portion (221) extending in the bottom hole (213) of the outer end of the barrel (21). The tip portion (221) has a slope (222).

During the pre-shaping process, plastic films are respectively mounted around the bodies of the molding devices (12) with top edges of the films protruding from the platform (120). When the plastic films are moved to correspond to the nozzles of the hot air generator (13) by the rotating table (11), the top edges are blown by hot air and formed into annular flanges around the top edges and then are cooled via the fans (14).

With further reference to FIGS. 3 to 6, when a plastic film (30) is mounted around the body of one molding device (12) and is pre-shaped into a circular shape with an annular flange, the platform (120) is raised by a driving shaft to lift the plastic film (30) from the body and into the longitudinal channel (210) of the barrel (21) via the opening (211). The airflow generated by the air generator (23) of the barrel (21) may blow the plastic film (30) toward the outer end of the barrel (21), to make the plastic film (30) hit the block wall (212) and drop and mount around the tip portion (221) of corresponding shelf (22) along the slope (222) to be gathered. The positions of the shelves (22) can be changed for loading or unloading the plastic films.

Consequently, the plastic film (30) may easily and automatically be gathered from the main body (10). Therefore, the plastic films (30) can be kept from being damaged and the pre-shaping process is accelerated.

Even though numerous characteristics and advantages of the present invention have been set forth in the foregoing description together with details of the structure and function of the invention, the disclosure is illustrative only. Changes may be made in detail especially in matters of shape, size, and arrangement of parts within the principles of the invention to the full extent indicated by the broad general meaning of the terms in which the appended claims are expressed.

What is claimed is:

1. An automatic gathering pre-shape machine comprising a main body being installed with a power supplier and having a top surface;

a rotating table being mounted rotatably on the top surface of the main body, rotated by the power supplier and kept at specific angular positions in a determined period of time; and multiple molding devices each having a body being rotatably mounted in the rotating table and having an annular side surface and a top;

a platform being detachably mounted in the top of the body; and a driving shaft being mounted longitudinally through the body, movably extending longitudinally relative to the body and having a top end attached securely to the platform to selectively raise the platform; and a gathering device being mounted adjacent to the rotating table and having a barrel being mounted securely on the top surface of the main body and having an inner end being disposed above the rotating table and having an opening communicating with the longitudinal channel and selectively corresponding to one of the molding devices;

an outer end having a bottom hole and a block wall extending downwardly adjacent to the bottom hole;

a longitudinal channel defined in the barrel; and an air flow generator being mounted in the inner end of the barrel and generating airflow flowing toward the outer end of the barrel; and at least one shelf being mounted on the main body and each one of the at least one shelf having a tip portion extending into the bottom hole of the outer end of the barrel and having a slope.

2. The automatic gathering pre-shape machine as claimed in claim 1, wherein the at least one shelf is mounted on a stage that is slidably mounted on a board attached to the main body by grooves and rails.

3. The automatic gathering pre-shape machine as claimed in claim 1, wherein the main body further has a hot air generator being mounted adjacent to the rotating table and having multiple nozzles corresponding to and spraying hot air to the rotating table; and multiple fans being mounted on the top surface of the main body adjacent to the hot air generator and the rotating table.

* * * * *